US005530979A

United States Patent [19]

Whitley

[11] Patent Number: 5,530,979

[45] **Date of Patent: *Jul. 2, 1996**

[54] MATTRESS COVERINGS

[75] Inventor: John W. Whitley, Monroe, N.C.

[73] Assignee: Perfect Fit Industries, Inc., Monroe, N.C.

[ * ] Notice: The term of this patent shall not extend beyond the expiration date of Pat. No. 5,325,555.

[21] Appl. No.: 269,487

[22] Filed: Jul. 1, 1994

Related U.S. Application Data

[63] Continuation-in-part of Ser. No. 45,643, Apr. 9, 1993, Pat. No. 5,325,555.

[51] Int. Cl.[6] ..... A47G 9/04; A47G 9/02

[52] U.S. Cl. ..... 5/500; 5/497

[58] Field of Search ..... 5/497, 500, 502, 5/482, 495, 496; 297/224

[56] References Cited

U.S. PATENT DOCUMENTS

| | | | |
|---|---|---|---|
| 2,528,313 | 10/1950 | Kessler | 5/354 |
| 2,569,627 | 10/1951 | Black | 5/497 |
| 2,856,615 | 10/1958 | Cirocco | 5/354 |
| 2,942,280 | 6/1960 | May, Jr. | 5/497 |
| 3,020,566 | 2/1962 | Anderson et al. | 5/334 |
| 4,042,986 | 8/1977 | Goodman et al. | 5/335 |
| 4,651,370 | 3/1987 | Vitale | 5/497 |
| 4,672,702 | 6/1987 | Isham | 5/497 |
| 4,703,530 | 11/1987 | Gusman | 5/497 |
| 4,757,564 | 7/1988 | Goodale | 5/451 |
| 4,962,546 | 10/1990 | Vitale | 5/497 |
| 4,980,941 | 1/1991 | Johnson, III | 5/497 |
| 4,985,953 | 1/1991 | Seago | 5/497 |
| 5,127,115 | 7/1992 | Williams et al. | 5/497 |
| 5,325,555 | 7/1994 | Whitley | 5/500 |

FOREIGN PATENT DOCUMENTS

| | | | |
|---|---|---|---|
| 0425466 | 5/1991 | European Pat. Off. | 5/497 |

OTHER PUBLICATIONS

Perfect Fit Industries package insert for Flexwall Bedsack® Mattress Pad package insert No. 913864, shipped by Feb. 1993.

*Primary Examiner*—Alexander Grosz

*Attorney, Agent, or Firm*—Panitch Schwarze Jacobs & Nadel

[57] ABSTRACT

A mattress covering in the form of a fitted mattress pad or fitted sheet has a top portion, an inelastic side skirt extending perpendicularly from the top portion, an elastic underskirt extending from the side skirt and a separate elastic strand attached to the elastic skirt at its open outer periphery. The top portion is dimensioned to fit a standard size mattress and the side skirt and underskirt are dimensioned to fit a range of mattress heights. The side skirt can be made of the same quilted or sheet material as the top portion for attractive appearance, or it can be made of other material, such as a single layer of an inelastic nonwoven, inexpensive sheet, to minimize cost. The elastic underskirt can be made of three layer material having a pair of inelastic outer layers gathered by and bonded to an elastic inner layer, or elastic thread stitched or woven into an inelastic fabric layer.

20 Claims, 7 Drawing Sheets

MATTRESS COVERINGS

This application is a continuation in part of application Ser. No. 08/045,643 filed Apr. 9, 1993, now U.S. Pat. No. 5,325,555.

BACKGROUND OF THE INVENTION

The present invention relates generally to mattress coverings, such as mattress pads and sheets, and more particularly to a new and improved fitted mattress covering capable of practical and effective use with mattresses of a standard top surface size and standard range of heights.

Fitted mattress pads and sheets are commonly used and are available in various forms. Probably the simplest form of fitted sheet or mattress pad is one having the top and sides formed of the same material that is cut and sewn to fit a standard size or range of sizes of mattresses and has an elastic band or cord attached around the lower periphery to draw the lower edge of the covering under the mattress to retain the covering in fitted condition. The corners of this type of covering are either entirely straight in the vertical direction or curved to facilitate pulling in under mattresses of varying heights. Such coverings have the advantage of ease of manufacture and the desirable appearance of the sides being of the same material as the top, e.g. quilted sides and top. They have the disadvantage, however, of utilizing only an elastic band to retain an otherwise inelastic covering on a mattress, and they have the disadvantage of being expensive to make the covering with the top surface material, e.g. quilted material, extending down through the sides sufficient to provide enough material to extend under a mattress of relatively great thickness (i.e. high height) so that the covering can be sold for use with mattresses of varying heights.

Another form of covering is a mattress pad that has a quilted top and an elastic side skirt that extends downwardly sufficiently to cover the sides and extends under mattresses of varying heights within a standard range for retention of the covering of the mattress. An elastic band or cord is attached to the lower periphery to facilitate retention of the covering on the mattress. Normally, such coverings are made with corners that are curved in the vertical direction to facilitate fitting under mattresses of varying height. Such pads use skirts formed by joined together elastic and inelastic layers. Other pads use single layer skirts, which are elasticized by being stitched and gathered with multiple parallel rows of threads, or are elasticized by being woven with elastic threads. Such mattress coverings have the disadvantage of a different, and less desirable, appearance of the sides due to the use of the different material rather than being able to use the same material, such as the sheet or quilted material of the top.

SUMMARY OF THE INVENTION

In at least one aspect, the invention is a mattress covering adapted for fitted disposition over the top, sides, ends and corners of mattresses of predetermined standard top surface sizes comprising: a substantially inelastic, generally rectangular top portion having an outer periphery dimensioned to at least substantially cover a top surface of mattresses of one of at least one predetermined standard top surface size; a substantially inelastic side skirt extending transversely from the outer periphery of the generally rectangular top portion around the outer periphery top portion; an elastic underskirt extending away from a periphery of the side skirt remote from the top portion; and at least one separate elastic strand secured to the elastic underskirt at a periphery of said elastic underskirt remote from the side skirt, the at least one elastic strand extending at least partially around the elastic underskirt periphery.

BRIEF DESCRIPTION OF THE DRAWINGS

The foregoing summary, as well as the following detailed description of preferred embodiments of the invention will be better understood when in conjunction with the appended drawings. For the purpose of illustrating the invention, there is shown diagrammatically in the drawings, embodiments which are presently preferred as well as other alternate embodiments. It should be understood, however, that the invention is not limited to the specific methods and instrumentalities disclosed. In the drawings.

DETAILED DESCRIPTION OF THE PREFERRED EMBODIMENTS OF THE INVENTION

Figure 1:
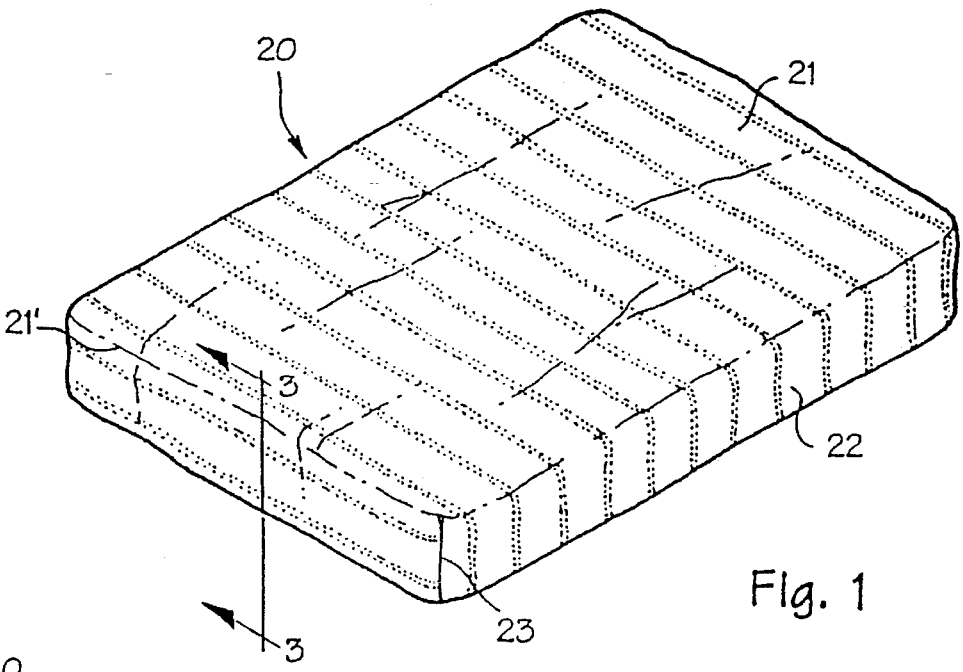
FIG. 1 is a perspective view of a mattress on which one form of the preferred embodiment of the mattress covering of the present invention is fitted.

One of the preferred embodiments of the mattress covering of the present invention is illustrated in FIGS. 1–7. In this form, the mattress covering 20 is a mattress pad adapted for fitted disposition over the top, side, ends and corners of mattress of predetermined standard top surface sizes and has an at least substantially and preferably essentially inelastic, generally rectangular top portion 21 of conventional, preferably quilted pad material. Preferably integrally formed of the same material as and as an extension from an outer periphery 21' of the top portion 21, extending around and transversely away from the outer periphery 21' of top portion 21, is an at least substantially and preferably essentially inelastic side skirt 22. Side skirt 22 is formed with corners 23 that extend transversely and preferably at least generally perpendicularly and straight from the corners of the outer periphery 21' of the generally rectangular top portion 21 to fit closely over the corners, sides and ends of a mattress. Side skirt 22 has a "lower" periphery 22' which is on a side of the side skirt 22 remote from the top portion 21. Secured to and extending around and away from the lower periphery 22' of the side skirt 22 is an elastic underskirt 24. In the embodiments illustrated in FIGS. 1–16, the elastic underskirt 24 is preferably formed from a multilayered material including at least one and preferably a pair of layers 25, 25' of at least substantially and preferably essentially inelastic material and a layer of an elastic material 26 between the pair of layers 25, 25' and to which the outer layers 25, 25' are attached at a plurality of points. The underskirt 24 is elasticized for contraction under a mattress to draw the lower open end of the mattress pad 20 into a more closely fitting relation on the mattress and to retain the mattress pad 20 on the mattress with minimum shifting or other movement. To further facilitate the retention of the mattress pad 20 on the mattress, at least one elastic strand 27 of a conventional elastic material used in bedding, like a latex rubber strip, is secured to a periphery 24' of the elastic underskirt 24 remote from side skirt 22, at a "free" edge of the elastic underskirt, in a conventional way such as by being stitched in a conventional arrangement directly to the underskirt 24 or in a fold 28 of the underskirt 24 at the periphery 24' of the underskirt 24. The elastic strand 27 extends at least partially and preferably essentially entirely around the outer periphery 24' of elastic underskirt 24.

Figure 3:
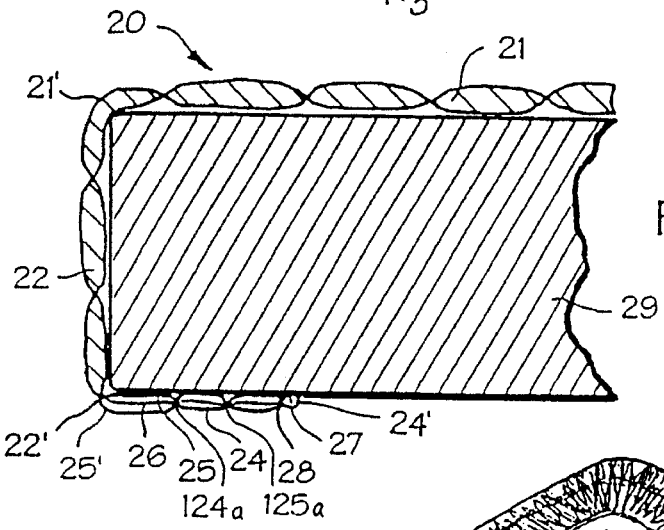
FIG. 3 is a partial vertical sectional view taken along line 3—3 of FIG. 1.
Figure 2:
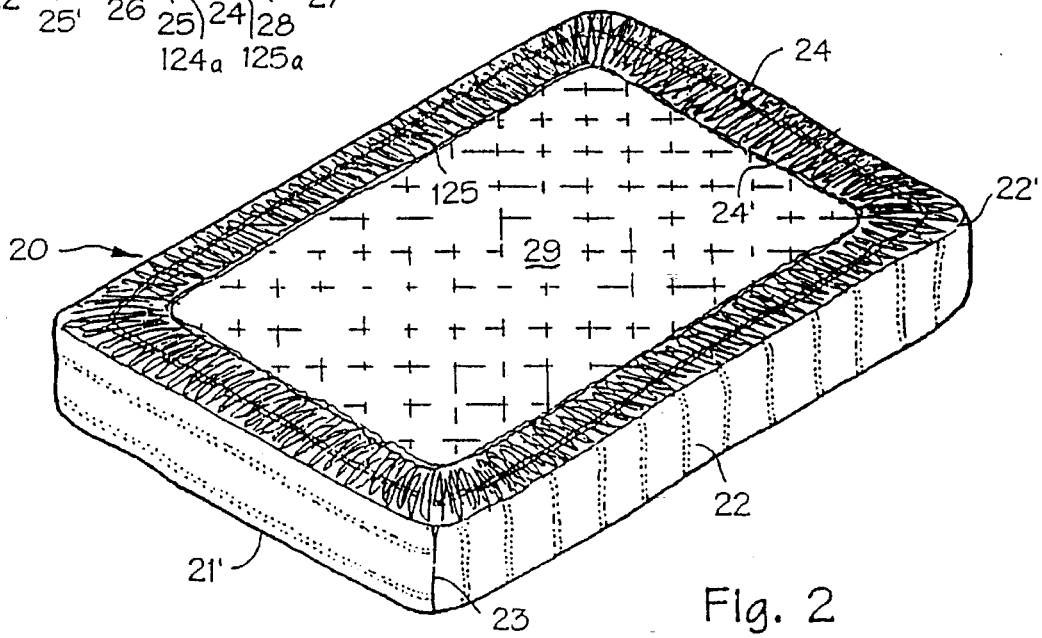
FIG. 2 is a perspective view of the mattress and covering of FIG. 1 as viewed looking toward the bottom of the mattress and covering.

With this combination substantially inelastic side skirt 22/elastic underskirt 24 construction, the mattress pad 20 is capable of practical and effective use on standard size mattresses within a relatively wide range of heights. As illustrated in FIGS. 1, 2 and 3, the mattress pad 20 is fitted on a mattress 29 of at least one predetermined standard top surface size (e.g. twin, full, queen, king, western or California king, etc.). The outer periphery 21' of the top portion 21 of the mattress pad 20 dimensioned to at least substantially and preferably essentially cover the top surface of mattresses of the at least one predetermined standard top surface size by having length and width dimensions substantially and preferably essentially the same as the predetermined standard length and width top surface dimensions of the standard type mattress on which the pad is to be used. The side skirt 22 has a width dimension between the top portion 21 and elastic underskirt 24 (i.e. extends downwardly from the top portion 21 an extent) at least equal to a width dimension of the underskirt 24 and preferably substantially the same as a height of an intermediate height mattress 29 within a predetermined standard range of heights. For example, in the United States, standard mattress heights currently range from less than about five inches to as many as about fourteen or more inches. An "intermediate" height of that standard range currently would be between about eight and about eleven inches, for example. Thus, side skirt 22 preferably but not necessarily has a height of between about eight inches and about eleven inches, for example, about nine and one half inches. Such a side skirt could have a width dimension between outer peripheries 21' and 22' of the top portion and side skirt at least a great as and preferably between about one and four times as great as the width of elastic underskirt between outer peripheries 22' and 24' of the side skirt and underskirt, respectively.

As can be seen in the drawings, the top and the sides of all mattress pad are formed with the same attractive quilted material, which preferably extends down only to the bottom of the side walls of the intermediate height mattress 29, with the underskirt 24 being hidden under the mattress. This reduces to a minimum the amount of quilted material that must be used in making the mattress pad of this particular size and provides an underskirt 24 of sufficient width to effectively draw the mattress pad 20 into fitted disposition with the mattress 29 and the straight corners 23 fitting neatly at the corners of the mattress.

Figure 4:
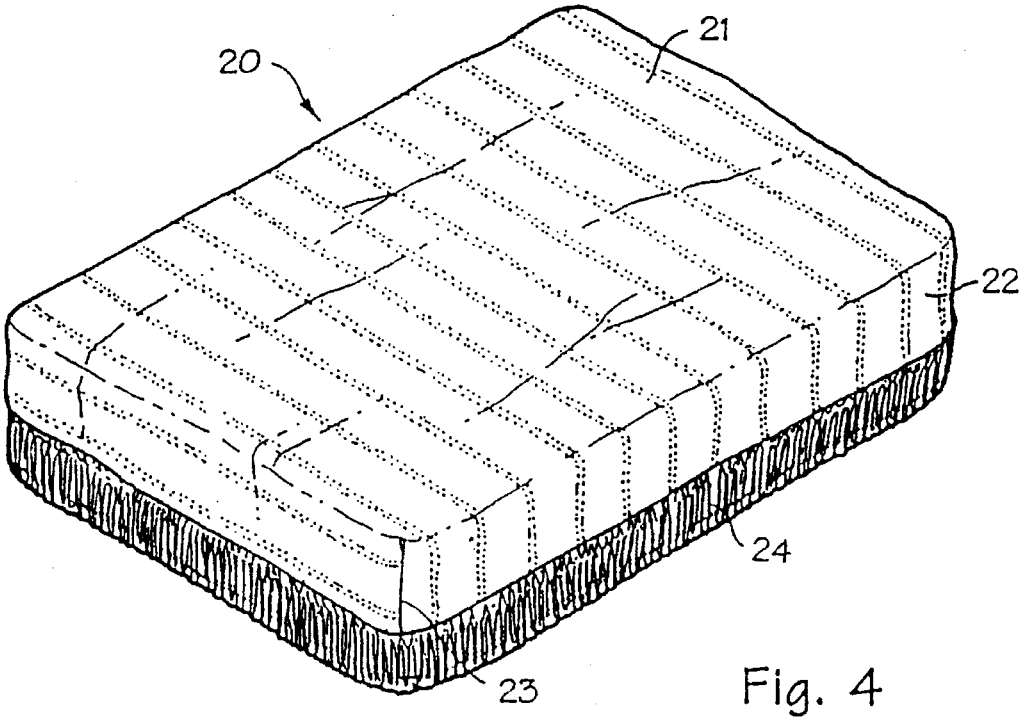
FIG. 4 is a perspective view showing the mattress covering of FIG. 1 fitted on a mattress of a higher height than the mattress of FIG. 1.
Figure 5:
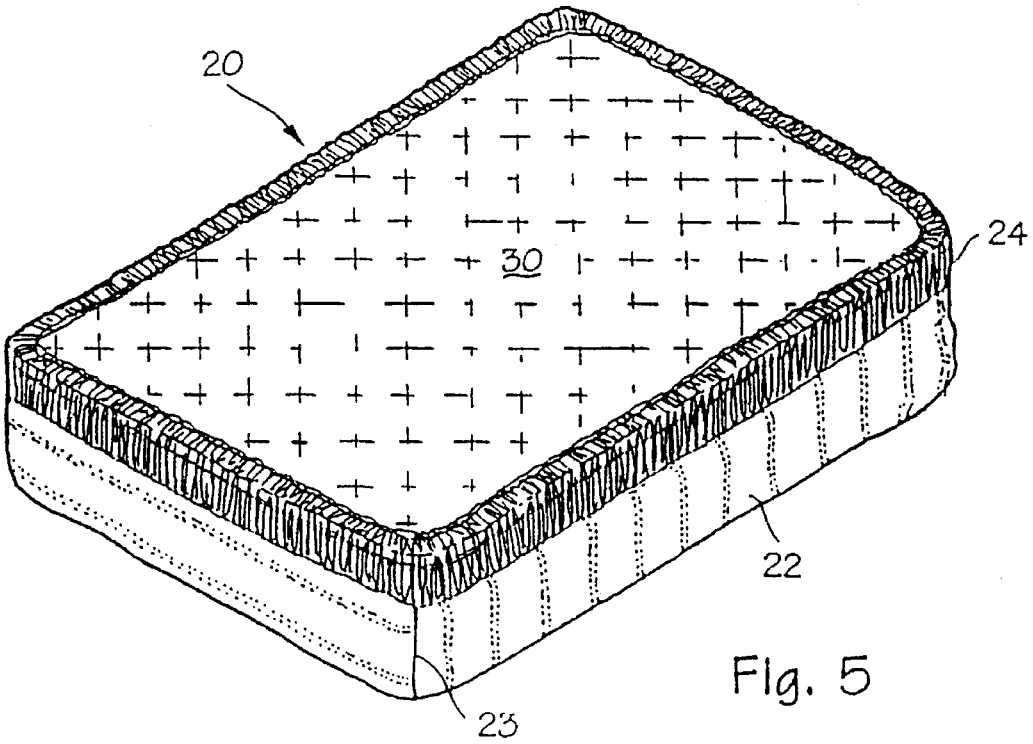
FIG. 5 is a perspective view of the mattress and covering of FIG. 4 as viewed looking toward the bottom of the mattress.

In FIGS. 4 and 5, the same mattress pad 20 used with the intermediate height mattress 29 in FIGS. 1, 2 and 3 is shown fitted on a mattress 30 of a height corresponding to the generally thickest portion (i.e. greatest height) of the standard range of heights for the mattress size for which the pad is adapted. Currently, this is about fourteen inches. In this installation, the side skirt 22 extends down to a location short of the bottom of the mattress sides and ends and the underskirt 24 extends downwardly, preferably covering the remainder of the mattress sides and ends and continuing under the mattress 30 an extent sufficient to provide sufficient elasticity to draw the mattress pad 20 into fitted relation to the mattress and to retain the pad 20 on the mattress. If the mattress is thicker (taller) than the combined heights of the sidewall 22 and underskirt 24, as may occur with the very thickest of current mattresses or with future, thicker mattresses, then the elasticized underskirt and strand 27 of elastic material will grip the sides and ends of the mattress to retain the mattress pad 20 in position on the mattress.

Figure 6:
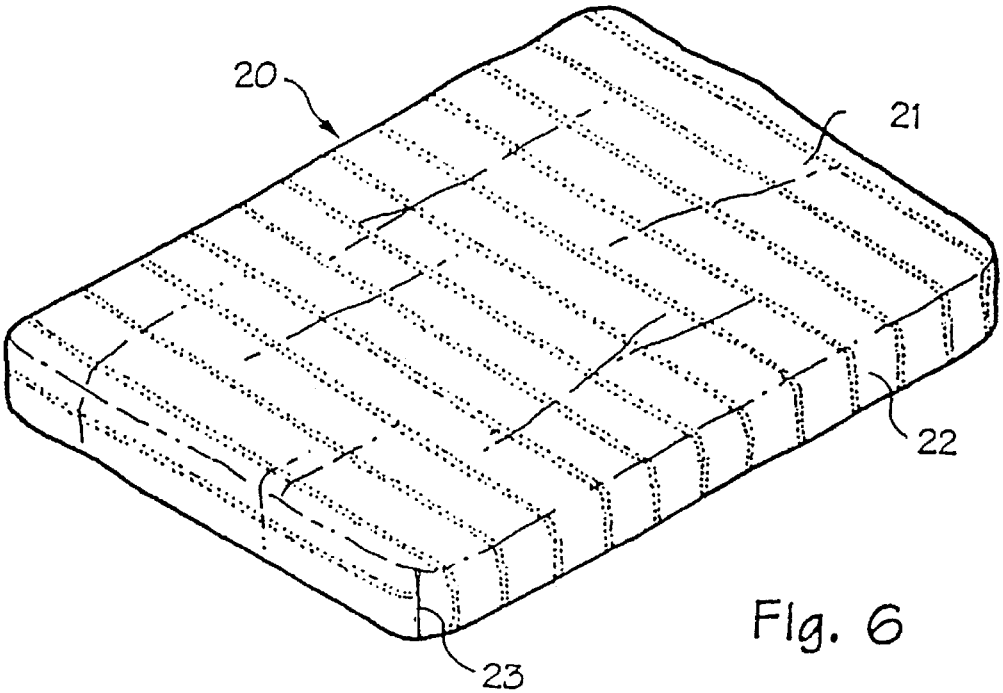
FIG. 6 is a perspective view of the mattress covering of FIG. 1 fitted on a mattress of a lower height than the mattress of FIG. 1.
Figure 7:
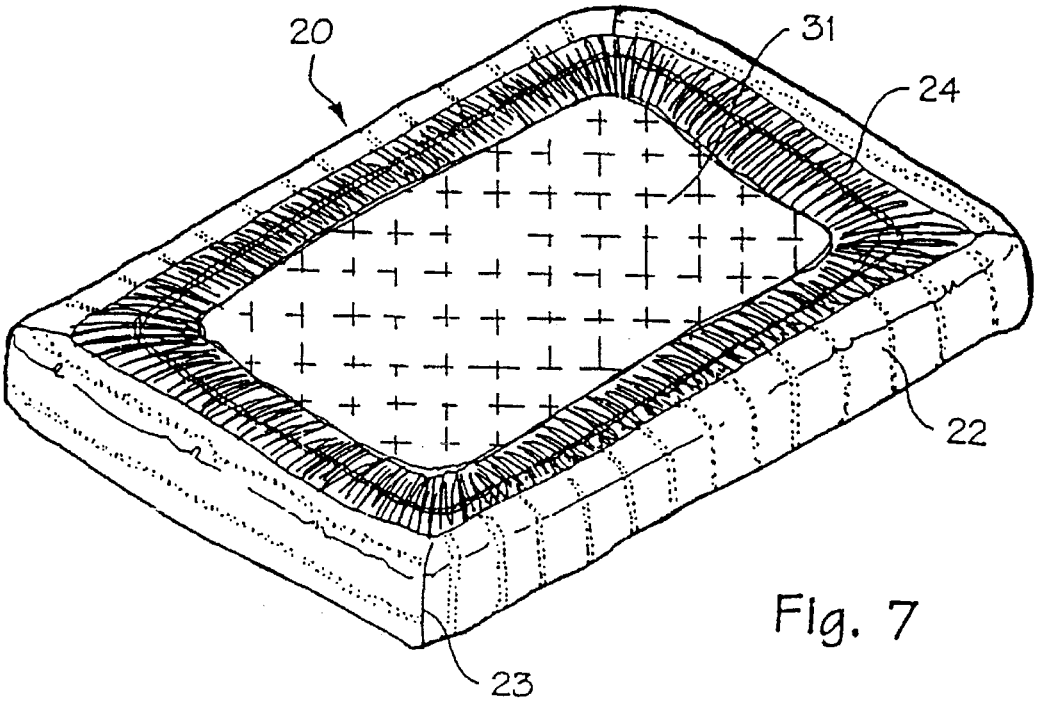
FIG. 7 is a perspective view of the mattress and covering of FIG. 6 as viewed looking toward the bottom of the mattress.

In FIGS. 6 and 7, the same mattress pad 20 is illustrated fitted on a mattress 31 of a thickness corresponding generally to the thinnest (lowest height) portion of the standard range of heights of the mattress type on which the pad 20 is adapted to be used. In this application, the side skirt 22 extends from the top portion 21 a distance greater than the height of the mattress and, therefore, partially extends under the mattress 31, with the underskirt 24 (and the elastic strand 27) extending further under the mattress 31 to draw the mattress pad 20 into fitted relation on the mattress 31.

Figure 8:
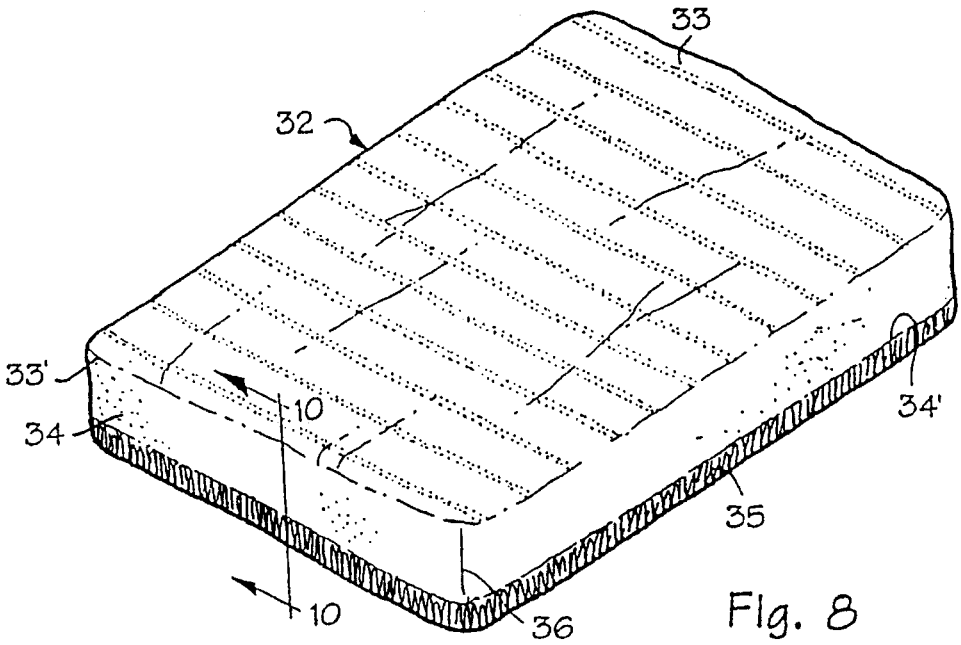
FIG. 8 is a perspective view of a mattress covering of another form of the preferred embodiment of the present invention fitted on a mattress.
Figure 10:
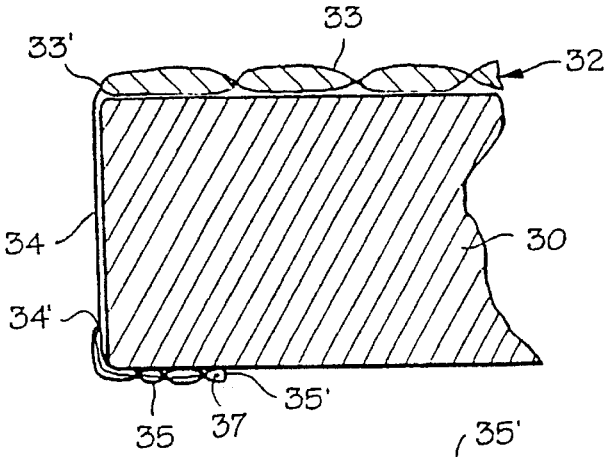
FIG. 10 is a partial vertical sectional view taken along line 10—10 of FIG. 8.
Figure 9:
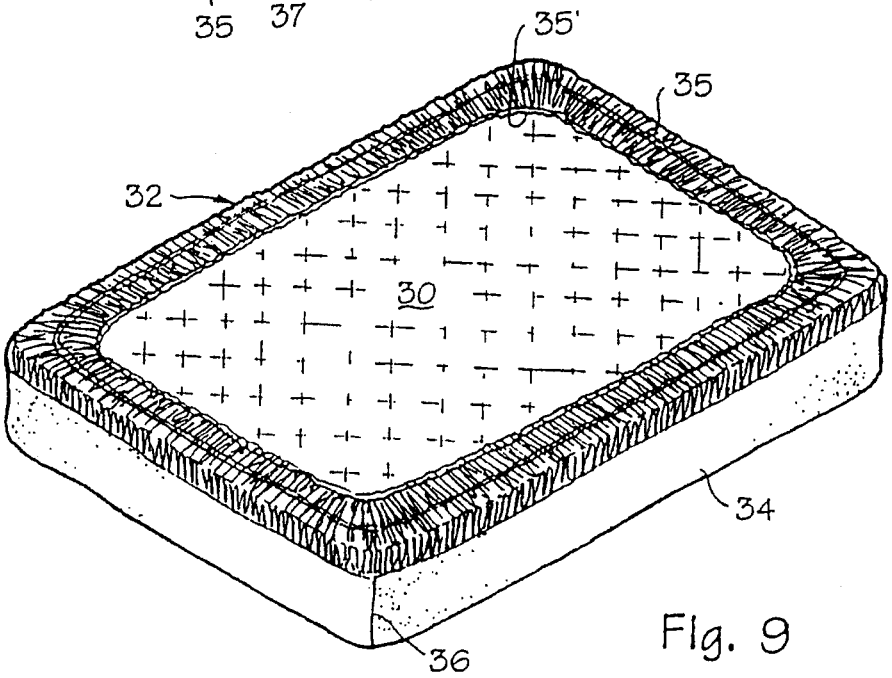
FIG. 9 is a perspective view of the mattress and covering of FIG. 8 as viewed looking toward the bottom of the mattress.

Another of the preferred embodiments of the present invention is depicted in FIGS. 8–10. Mattress pad 32 has the same type of quilted top portion 33 as the top portion 21 of mattress pad 20 of the previously described embodiment, but, instead of having a side skirt 22 formed of the same quilted material as the top portion, it has an at least substantially and preferably essentially inelastic side skirt 34 joined to the outer periphery 33' of top portion 33, which is formed of a conventional inelastic sheet material having the same general dimensions as the side skirt 22 of the previously described embodiment. Side skirt 34 has secured to and extending from its periphery 34' remote from the top portion 33, an elastic underskirt 35 of the same type and dimensions as the elastic underskirt 24 of the previously described embodiment 20, with an elastic strand 37 similar to elastic strand 27 attached to its outer periphery 35'. The side skirt 34 of this embodiment 32 can be provided effectively with the same generally vertical, generally straight corners 36 as in the preceding embodiment 20 and the same fitting characteristics and versatility, but can be less expensive to manufacture because it permits the use of an inexpensive, single layer of material for side skirt 34 rather than a multi-layered quilted side skirt 22 of the previously described embodiment, which also does not need to be elasticized.

Figure 11:
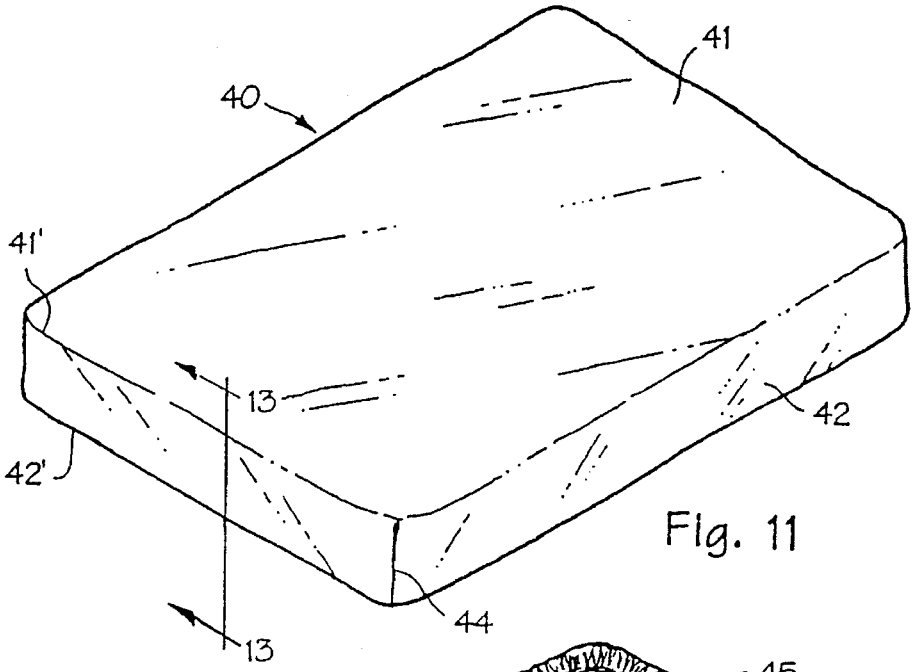
FIG. 11 is a perspective view of a mattress covering of a further form of the preferred embodiment of the present invention fitted on a mattress.
Figure 12:
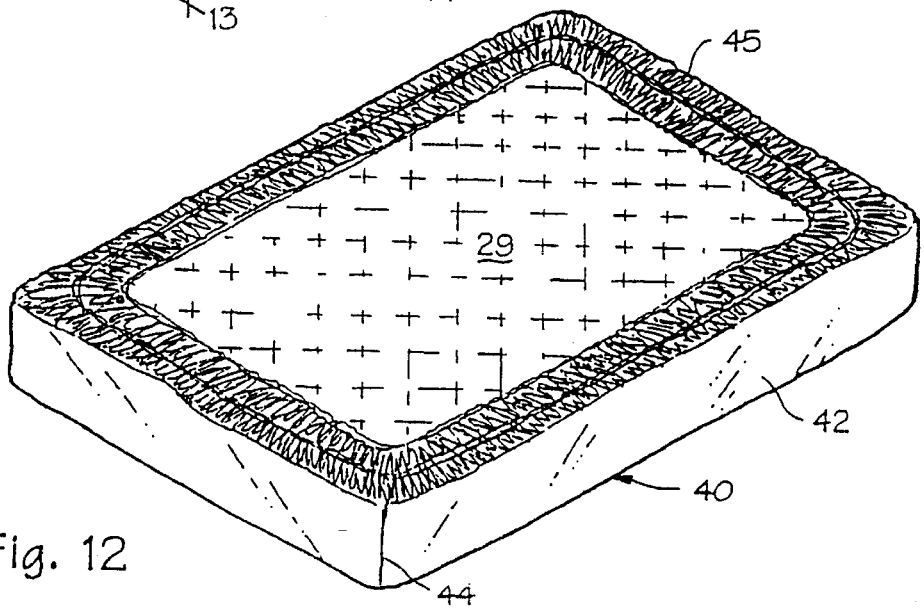
FIG. 12 is a perspective view of the mattress and covering of FIG. 11 as viewed looking toward the bottom of the mattress.
Figure 13:
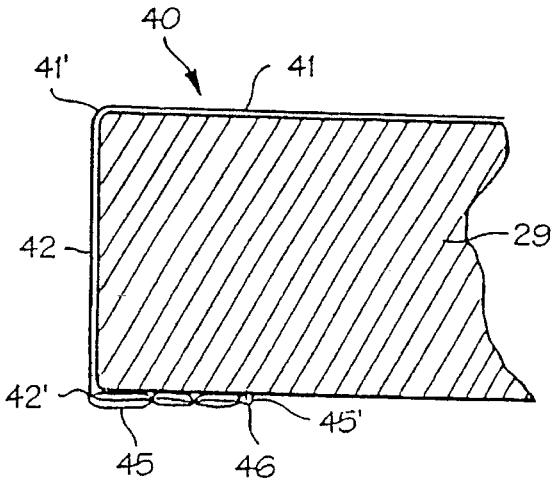
FIG. 13 is a partial vertical sectional view taken along line 13—13 of FIG. 11.

Mattress coverings of the present invention can also take the form of a fitted sheet as well as a mattress pad. The form of a preferred embodiment as a fitted sheet 40 is illustrated in FIGS. 11, 12 and 13. In this embodiment, the fitted sheet 40 has a top portion 41 with outer periphery 41' dimensioned generally the same as a predetermined top surface size of a mattress of the type on which it is to be used to at least substantially cover top surfaces of mattress of at least one predetermined standard top surface size. This top portion 41 is formed preferably of a single layer of a conventional, at least substantially and preferably essentially inelastic woven or unwoven textile sheet material. An at least substantially inelastic side skirt 42 extends integrally from the outer periphery 41' of the top portion 41 preferably a distance generally the same as the height of mattress 29 from an intermediate height portion of a standard range of mattress heights, so as to provide a covering for at least substantially all of the sides and ends of the mattress 29. The corners 44 of the side skirt 42 extend at least transversely and, preferably, generally perpendicularly and generally straight from corners of the rectangular top portion 41 in a manner similar to the extent of the corners of the previously described embodiments 20 and 32. Extending away from and around a periphery 42' of the side skirt 42, remote from the top portion 41, for fitting under the mattress 29, is an elastic underskirt 45 similar to the laminated, three layer, elastic underskirts 24 and 35 of the previously described embodiments. Underskirt 45 preferably includes an elastic strand 46 secured to or in a fold of its outer periphery 45', remote from the side skirt 42, extending at least partially and preferably entirely around the periphery 45' of the underskirt 45, to facilitate retention of the sheet 40 in fitted disposition on any of the mattresses 29, 30, 31.

In making the mattress pads 20 and 32 or the fitted sheet 40, generally straight, perpendicularly extending corners 23, 36 of the mattress pads 20, 32 and corners 44 of the fitted sheet 40 may be formed in one piece by providing generally square recesses 50 in the same material 51 integrally forming the top portion and side skirt. This material 51, with square recesses 50 in the corners, can be made from a single piece of a multi-layer quilted material in making the mattress pad 20 described above or from a single layer of a conventional woven or non-woven textile sheet material in making the fitted sheet 40 described above.

In making mattress pad 32 having a side skirt 34 formed of material different than the material of the top portion 33, which can also be done with fitted sheet construction, the width of material for making the side skirt can be provided by sewing to a rectangular piece of material that forms the top portion, one or more strips.

Figure 14:
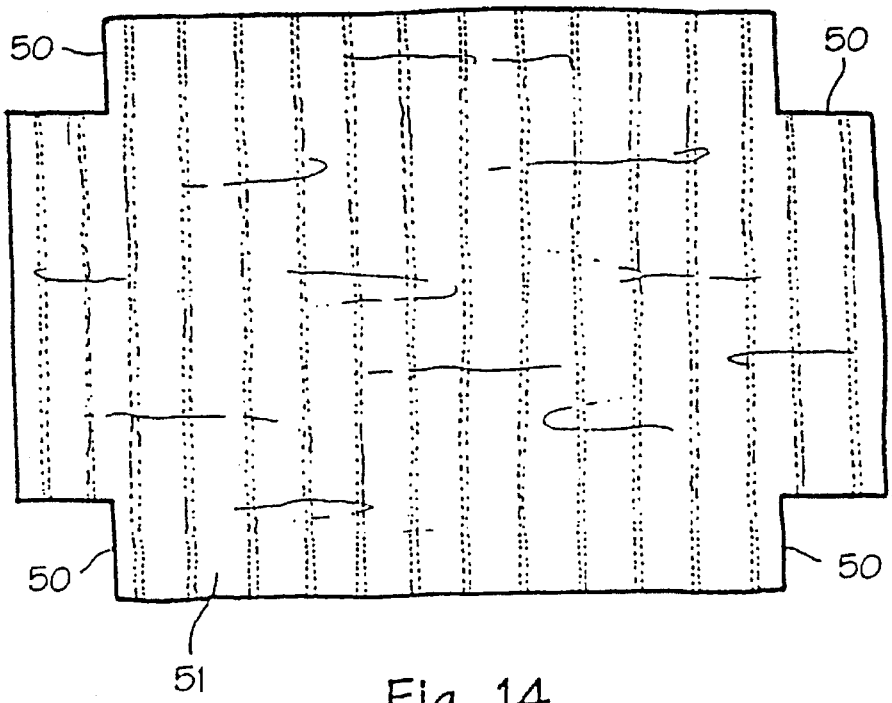
FIG. 14 is a plan view of quilted sheet material formed for use in providing the top portion and side skirt of the mattress covering illustrated in FIG. 1.
Figure 15:
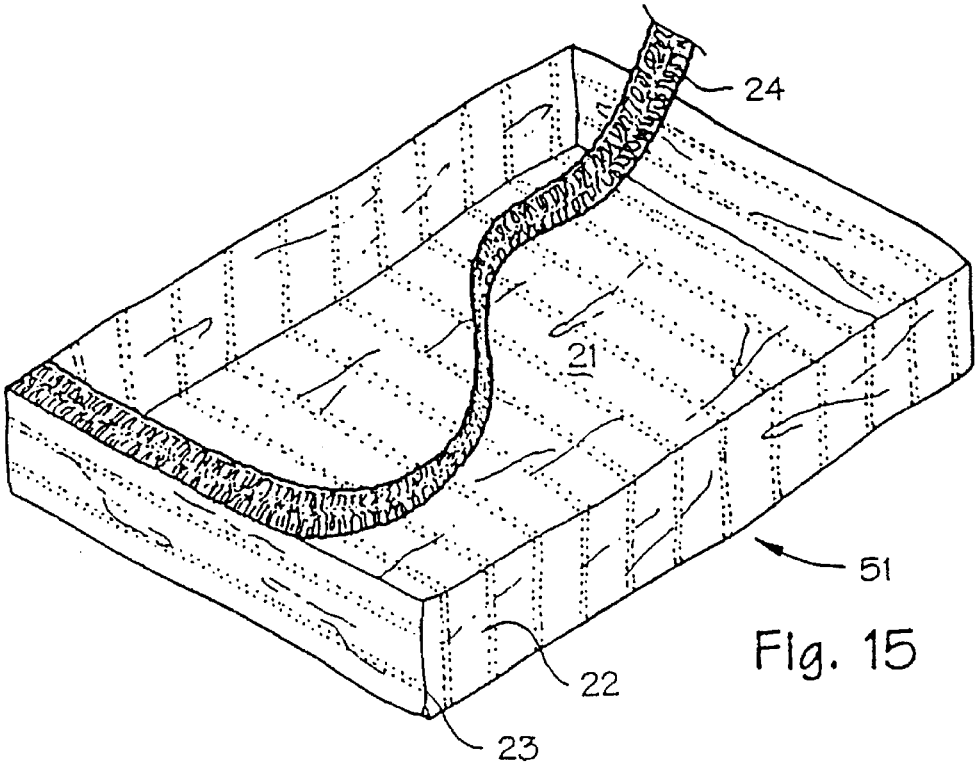
FIG. 15 is a perspective view of a partially manufactured covering of the type illustrated in FIG. 1.

For example, the side skirt portion may be formed in four strips, two of which have the same length as the length of the top portion and two of which have the same length as the width of the top portion, thereby leaving square recesses at the corners of the composite material after the side skirt material strips have been sewn to the material forming top portion, with configuration similar to that illustrated in FIG. 14. After the central panel and multiple strips have been joined together to define the square recesses at the corners, the strips that will form the side skirt are turned down vertically so that the edges of the recesses abut each other. These edges are then sewn together to form the corners 23, 36 and 44 preferably extending at least generally perpendicularly and straight from corners of the top portion 21, 33 and 41. A strip of elastic material forming the underskirt 24 is then sewn (FIG. 15) around the periphery 22' of the side skirt 22.

Figure 16:
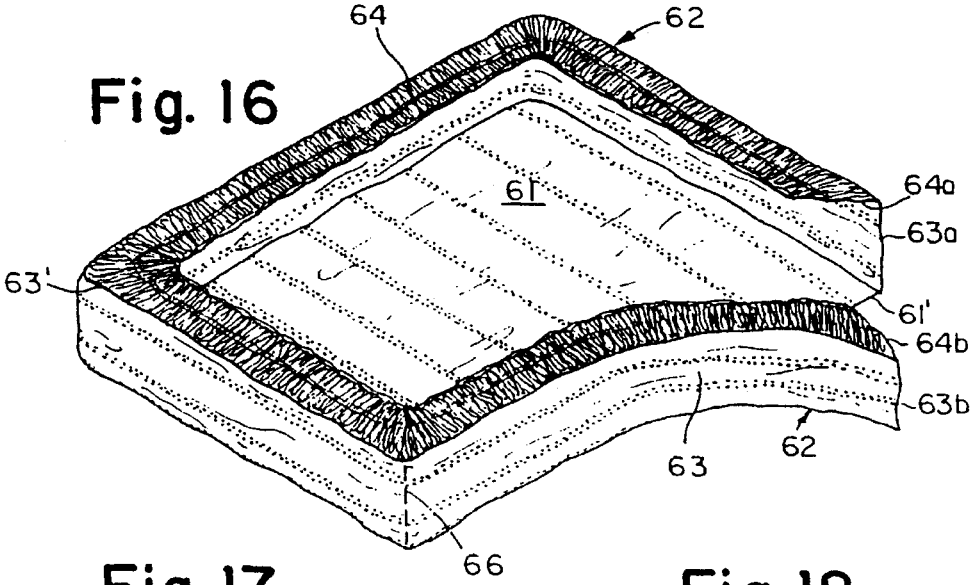
FIG. 16 is a perspective view of another mattress cover construction.

Alternatively, the side skirt of mattress pad 32 (or fitted sheet 40) can be formed directly from a single continuous strip of material, which has a length equal to the length of the outer periphery of the top portion of the covering and which is attached to the outer periphery of the top portion entirely around the periphery as shown, for example, in FIG. 16. A single continuous length of material 62 is attached to the outer periphery 61' of a substantially inelastic, generally rectangular top portion 61, having an outer periphery 61' dimensioned to at least generally cover a top surface of mattresses of a predetermined standard top surface size. An elastic underskirt 64 may be preliminarily attached to an outer periphery 63' of the inelastic side skirt 63 remote from the top portion 61, extending around and away from the periphery 63' of the side skirt 63. Ends **63*a*, 63*b* of the side skirt 63 and ends 64*a*, 64*b* of the elastic underskirt 64 are further similarly joined together in a conventional fashion, such as by stitching, preferably to form one of four corners 66 extending generally straight and perpendicularly from a corner of the rectangular top portion 61. Alternatively, the elastic underskirt 64 may be attached to the side skirt 63 after the side skirt material has been attached to the top portion 61. A separate elastic strand (not depicted) can be secured to or in a fold at the remote periphery 64' of the underskirt 64 in a conventional fashion. This could be done before or preferably after the side skirt 63 and underskirt 64 were attached to the top portion 61 of the covering 60** in the manner previously described.

FIGS. 1–16 depict elastic underskirts 24, 35, 45 and 64, which might be made in the manner disclosed in U.S. Pat. No. 4,962,546, incorporated by reference herein in its entirety, in which at least one and typically a plurality of rows 124, 125 of inelastic thread stitches **124*a*, 125*a* (see FIG. 2) are provided extending circumferentially around the underskirt 24 to attach the elastic material layer 26 to each of the inelastic material layers 25, 25' at a plurality of points where the stitches pass through the three layers 25, 26, 25'. Such an underskirt 24 can be formed by passing the elastic layer 26 in a stretched condition between the two outer layers 25, 25' in a machine direction through a sewing machine and stitching the three layers together with the one or more lines of inelastic thread stitches. Two lines 124 and 125 of stitches 124*a*, 125*a*, respectively, are indicated in FIGS. 2 and 3. Lines 124, 125 preferably extend in parallel to one another and in the machine direction of the three layers 25, 26, 25'. The underskirt 24 preferably is extended circumferentially around the side skirt 22 in the machine direction of underskirt so that when the underskirt is fully stretched, the lines 124 and 125 of stitches extend generally parallel to one another and longitudinally or circumferentially around the underskirt 24, generally parallel to longitudinal dimensions of the sides and ends of the mattress 29 and to the outer peripheries 21', 22' and 24' of the top portion 21, side skirt 22 and underskirt 24**, respectively.

Still referring to FIG. 2, the inelastic layers 25, 25' between adjoining pairs of the stitches 124*a* or 125*a* penetrating those layers in each of the row of stitches 124, 125 are gathered into folds indicated generally at 126 when the elastic material 26 is permitted to at least partially relax from its fully stretched condition. Preferably, the immediately adjoining stitches of each of a line of stitches 124, 125 more closely adjoin one another than do the immediately adjoining lines of stitches 124, 125. The lines 124, 125 constitute a pair of spaced apart, parallel lines of attachment points (i.e. the stitches 124*a*, 125*a*), which also extend generally parallel to longitudinal dimensions of the elastic underskirt 24 and side skirt 22 and generally perpendicularly to the folds 126 and longitudinal axes of those folds and generally parallel to longitudinal dimensions of the sides and ends of the mattress as well as the inelastic side skirt 22 and elastic underskirt 24 and to peripheries 21', 22' and 24' of the top portion 21, inelastic skirt 22 and elastic underskirt 24, respectively. Lines 124, 125 extend at least substantially and preferably essentially entirely around the underskirt 24.

Figure 17:
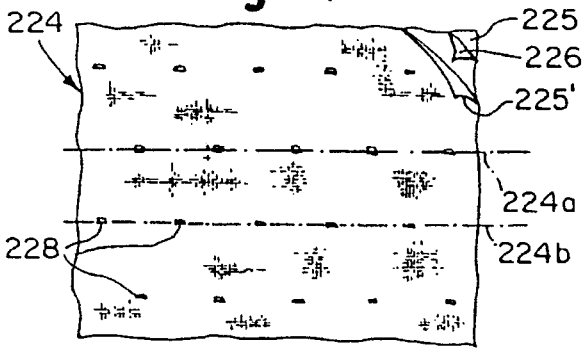
FIG. 17 is an enlarged elevational view of a preferred embodiment underskirt material construction for use on a mattress covering of the present invention when the material is fully tensioned.
Figure 18:
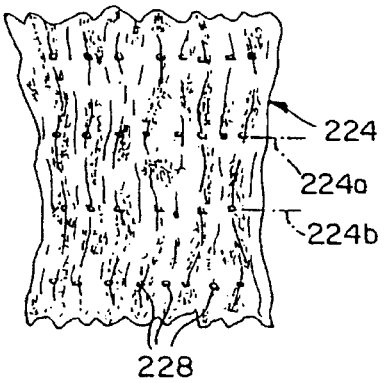
FIG. 18 is an enlarged elevational view of the underskirt material of FIG. 17 when it is at least partially relaxed.

FIGS. 17 and 18 depict a fully tensioned and an at least partially relaxed form of a preferred elastic underskirt material construction of the present invention indicated generally at 224, which is formed by an elastic material layer 226, that is attached to at least one and preferably to each of a pair of at least substantially and preferably essentially inelastic outer material layers 225, 225'. The elastic material 226 may be an elastomeric, non-woven polymer fabric web formed by melt-blown fibers of the type(s) disclosed in either or both of the U.S. Pat. Nos. 4,707,398 and 4,741,949, incorporated by reference herein, which is sold under the trademark Demique® by the Kimberly Clark Corporation, or an extruded elastomeric netting sheet material identified as TN-4590 by CONWED PLASTICS, Minneapolis, Minn. Each outer layer 225, 225' preferably includes some thermoplastic, preferably polyester or polyetherester, content so as to be directly bondable with the preferred elastic material. For example, layers 225, 225' may be a woven, knitted or non-woven fabric with at least a forty percent and preferably at least a fifty percent polymeric content, which may be thermally bonded with the elastic material 226 in the manner disclosed in either of U.S. Pat. Nos. 4,720,415 or 4,801,482, each incorporated by reference in its entirety, or ultrasonically bonded to the elastic material layer 226 in a conventional manner with a conventional sonic quilting machine such as, for example, a Pinsonic® thermal bonding machines made by Morrison Berkshire, Inc. of North Adams, Mass. as well as machines made by a predecessor, James Hunter. Preferably, the polymer is polyester or polyetherester or is polyester or polyetherester based for sonic bonding while the non-polymer content is typically cotton. For the three-layer construction 25, 26, 25' or 225, 226, 225', it is preferred that the innermost layer 25, 225, be a non-woven one-hundred percent polyester layer, which provides the strongest bond to the elastic material layer 26, 226. The outer, facing sheet 25', 225' is preferably a non-woven polyester or a woven cotton polyester blend. Again, one-hundred percent polyester is preferred for strength purposes. However some consumers prefer the appearance and feel of a woven cotton blend fabric. As indicated in FIG. 17, the multiple layers of material 225, 226, 225' are bonded together with rows of individual thermal or sonic bond points 228. Preferably, the spacing between is adjoining points 228 in each row 224*a*, 224*b* of points 228 is no greater than and generally less than the spacing between adjoining the rows 224*a*, 224*b*. Furthermore, it is preferred that the points 228 of each row 224*a*–224*b* be alternately staggered with respect to one another as is further indicated in FIG. 17. It is further preferred that the rows extend at uniform spacing from one another as indicated in FIGS. 17 and 18 between the outer peripheries of the side skirt and underskirt at less than one inch intervals, suggestedly intervals of one-half inch (½) or less and, preferably, of about one-quarter inch (¼), with a spacing of approximately two-tenths inch (2/10) between points 228 in each row 224*a*, 224*b* (stretched dimensions). As is diagrammatically indicated in FIG. 18, the resulting material is extensively gathered across its entire surface with generally but not perfectly vertical, closely adjoining folds being formed when the material 224 is permitted to at least partially relax.

Figure 19:
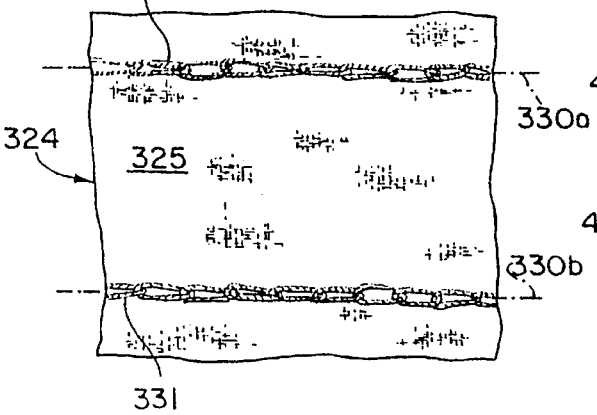
FIG. 19 is an enlarged elevational view of another exemplary underskirt material construction.

FIG. 19 depicts another form of elastic underskirt material 324 for use in a pad or a sheet, which includes at least one layer 325 of an at least substantially inelastic woven or non-woven fabric to which is attached at least one and preferably a plurality of elastic threads 330, 331, in at least generally parallel lines of stitches 330*a*, 331*a*. This material is made in the manner disclosed in U.S. Pat. No. 5,249,322, which is incorporated by reference herein in its entirety, by chain stitching conventional elastic threads 330, 331 under tension in a conventional manner onto the inelastic material layer 325. When the threads 330, 331 are allowed to begin to relax, they contract forming gathers and folds in the inelastic material 325 between adjoining pairs of the stitches at the points where stitches actually pass through the layer 325. The resulting gathers and folds, with their longitudinal axes, extend generally perpendicularly to the directions of the parallel lines 330*a*, 331*a*. Lines 330*a*, 331*a* of stitches 331*a* extend in a longitudinal direction along the underskirt, preferably generally straight and parallel to the outer peripheries of the top portion and side skirt of the covering in which the material is used. Lines 330*a*, 330*b* need not be straight, however, as the material can be made to stretch in different directions, if desired.

Figure 20:
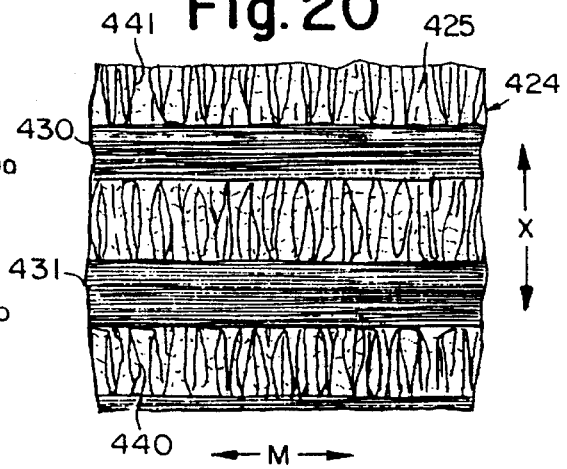
FIG. 20 is an enlarged view of yet another exemplary elastic underskirt material construction.

FIG. 20 depicts yet another form of elastic underskirt material 424 suitable for use in a mattress covering of the present invention. The material 424 is provided with stretch and elasticity primarily in a machine dimension "M", which preferably would run parallel to the peripheries of the top portion and side skirt of the mattress covering when the material 424 is used as an underskirt, by alternately knitting pluralities of Lycra® elastic threads in chain stitches in separate, spaced sets, into an essentially inelastic substrate fabric layer 425 in the machine dimension M, spaced intervals while nonelastic polyester threads are knitted in tricot stitches in a cross dimension "X" of the material 424, all as disclosed in U.S. Pat. No. 5,127,115, which is incorporated by reference herein in its entirety. The elastic threads form parallel smooth bands 430, 431 following the machine dimension of the fabric 425 while the inelastic polyester threads form rippled bands 440, 441 of loose folds extending between the smooth bands 430, 431. The elastic threads forming bands 430, 431 tightly gather the folds of the layer 425. The resulting gathers and their longitudinal axes extend generally perpendicularly to the bands 430, 431 and lines of elastic thread stitches, which define those bands and which extend in a longitudinal dimension of the underskirt, preferably generally parallel to the periphery of each of the top portion, side skirt and underskirt of the covering, preferably entirely around the underskirt, In addition to the constructions previously described, it is further envisioned that an elasticized underskirt material can be fabricated by needle punching loose, inelastic fibers into an elastic web in a conventional manner used in the bedding industry to fabricate unwoven blanket material utilizing conventional needle punching machines or "needle looms" like those which may be obtained from sources such as Fehrer of Austria, Automatex of Italy and/or Dilo of Germany. Loose fibers (polymer, natural or mixed), would be passed through such machines on either side of an elastic web such as, for example, either of the elastic webs disclosed above, while the elastic web was at least partially stretched or fully stretched. The loose fiber would be punched into either side of the elastic web by needles of the loom, embedding the loose fibers into one another and the elastic web, which ultimately ends up in the middle of the elasticized material between two layers of fibers fitted together and to the elastic web. Other known elasticized fabrics, made in other ways, can also be used in substitution for the elasticized fabric materials expressly noted above.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred and other embodiments, it is to be understood that this disclosure is only illustrative and exemplary of the present invention and is made merely for purposes of provided in a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A mattress covering adapted for fitted disposition over the top, sides, ends and corners of mattresses of predetermined standard top surface sizes comprising:

a substantially inelastic, generally rectangular top portion having an outer periphery dimensioned to at least substantially cover the top surface of mattresses of at least one predetermined standard top surface size;

a substantially inelastic side skirt extending transversely from the outer periphery of the generally rectangular top portion around the outer periphery of the top portion;

an elastic underskirt extending away from a periphery of the side skirt remote from the top portion; and at least one elastic strand secured to the elastic underskirt at a periphery of the elastic underskirt remote from the side skirt, the at least one strand extending at least partially around the elastic underskirt periphery.

2. The mattress covering of claim 1 wherein the elastic underskirt comprises:

a layer of at least substantially inelastic material;

elastic material attached to the inelastic material at a plurality of points, the inelastic material being gathered between at least some adjoining pairs of the plurality of points.

3. The mattress covering of claim 2 wherein the plurality of points are arranged in a plurality of spaced apart, generally parallel lines.

4. The mattress covering of claim 3 wherein the parallel lines extend generally in a longitudinal dimension of the elastic underskirt generally paralleling the outer periphery of the underskirt.

5. The mattress covering of claim 3 wherein the parallel lines extend generally in a longitudinal dimension of the elastic underskirt generally paralleling the outer periphery of the side skirt.

6. The mattress covering of claim 3 wherein the parallel lines extend generally in a longitudinal dimension of the elastic underskirt generally paralleling the outer periphery of the top portion.

7. The mattress cover of claim 3 wherein the parallel lines extend entirely around the underskirt.

8. The mattress covering of claim 2 wherein the inelastic fabric layer and elastic fabric layer are attached together with inelastic thread stitches.

9. The mattress covering of claim 2 wherein the inelastic fabric and elastic fabric layers are attached together ultrasonically.

10. The mattress covering of claim 2 wherein the elastic underskirt further comprises another layer of substantially inelastic material, the one layer of elastic material being attached between and to the one layer and the other layer of substantially inelastic material.

11. The mattress covering of claim 2 wherein the elastic underskirt comprises at least one layer of substantially inelastic fabric and at least one elastic strand stitched to the inelastic fabric between the outer periphery of the side skirt and the outer periphery of the elastic underskirt.

12. The mattress covering of claim 11 wherein the elastic strand is itself stitched into the inelastic fabric sheet with stitches of the elastic strand passing through the inelastic fabric sheet.

13. The mattress covering of claim 2 wherein the elastic underskirt comprises at least one layer of an at least substantially inelastic non-woven fabric with at least one elastic strand woven into the non-woven fabric in a direction extending at least generally longitudinally along the underskirt at least generally parallel to the outer periphery of at least one of the top portion, the side skirt and the elastic underskirt.

14. The mattress covering of claim 2 wherein the elastic underskirt comprises at least one layer of a thermoplastic elastic material bonded directly with an at least substantially inelastic fabric layer having at least some thermoplastic content at a plurality of bond points arranged in lines extending longitudinally around the elastic underskirt and in parallel uniformally spaced relation between the outer periphery of the side skirt and the outer periphery of the underskirt.

15. The mattress covering of claim 1 wherein said top portion and said side skirt are formed in one piece from the same material.

16. The mattress covering of claim 15 being a mattress pad and wherein the same material forming the top portion and the side skirt is quilted.

17. The mattress covering of claim 15 being a fitted sheet and wherein a single layer of textile sheet material forms the top portion and the side skirt.

18. The mattress covering of claim 1 wherein the side skirt has a width dimension between the outer periphery of the top portion and the outer periphery of the side skirt at least as great as a width dimension of the elastic underskirt between the outer periphery of the side skirt and the outer periphery of the underskirt.

19. The mattress covering of claim 18 wherein the width dimension of the side skirt is between about one and four times the width dimension of the elastic underskirt.

20. The mattress covering of claim 18 wherein said side skirt width dimension is at least six inches.

* * * * *